US009417559B2

(12) United States Patent
Iikura et al.

(10) Patent No.: US 9,417,559 B2
(45) Date of Patent: Aug. 16, 2016

(54) IMAGE FORMING APPARATUS

(71) Applicant: CANON KABUSHIKI KAISHA, Tokyo (JP)

(72) Inventors: Takayuki Iikura, Kashiwa (JP); Kazunori Miyake, Abiko (JP); Toshifumi Kakutani, Abiko (JP); Shinya Suzuki, Toride (JP); Yousuke Hata, Ichikawa (JP); Kazumi Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/444,820

(22) Filed: Jul. 28, 2014

(65) Prior Publication Data

US 2015/0037072 A1 Feb. 5, 2015

(30) Foreign Application Priority Data

Jul. 31, 2013 (JP) ..... 2013-159297

(51) Int. Cl.
*G03G 15/08* (2006.01)

(52) U.S. Cl.
CPC ..... *G03G 15/0877* (2013.01); *G03G 15/0868* (2013.01); *G03G 15/0872* (2013.01); *G03G 2215/0678* (2013.01)

(58) Field of Classification Search
CPC ..... G03G 15/0877; G03G 15/0868; G03G 2215/0678
See application file for complete search history.

(56) References Cited

U.S. PATENT DOCUMENTS

| | | | | |
|---|---|---|---|---|
| 8,565,649 | B2 | 10/2013 | Murakami et al. | |
| RE45,513 | E * | 5/2015 | Umezawa et al. | 399/12 |
| 2007/0140743 | A1 * | 6/2007 | Kamimura | 399/254 |
| 2007/0292150 | A1 * | 12/2007 | Lu | G03G 15/5004 399/34 |
| 2009/0269088 | A1 * | 10/2009 | Mizuta | 399/30 |
| 2012/0014722 | A1 * | 1/2012 | Okino et al. | 399/262 |
| 2013/0202275 | A1 * | 8/2013 | Brown | H02P 7/29 388/809 |
| 2015/0037051 | A1 * | 2/2015 | Iikura | G03G 21/1676 399/13 |

FOREIGN PATENT DOCUMENTS

| | | | |
|---|---|---|---|
| EP | 2416222 | A1 | 2/2012 |
| EP | 2416223 | A1 | 2/2012 |
| EP | 2624068 | A1 | 8/2013 |
| EP | 2624069 | A1 | 8/2013 |
| JP | 2010-256893 | A | 11/2010 |

* cited by examiner

*Primary Examiner* — David Gray
*Assistant Examiner* — Sevan A Aydin
(74) *Attorney, Agent, or Firm* — Canon USA Inc. IP Division

(57) ABSTRACT

An image forming apparatus includes a developing unit configured to develop using toner an electrostatic latent image formed on a photosensitive member, a mounting unit to which a container is mounted, the container including a containing unit configured to contain toner and a pump unit, and performing a supplying operation for supplying toner by expansion and contraction of the pump unit, a driving unit configured to rotationally drive the container to cause the container to perform the supplying operation, and a controller configured to control a rotational speed of the container based on a time for which the supplying operation has been performed.

17 Claims, 9 Drawing Sheets

IMAGE FORMING APPARATUS

BACKGROUND OF THE INVENTION

1. Field of the Invention

The present invention relates to an image forming apparatus to which a container containing toner is mounted.

2. Description of the Related Art

An electrophotographic image forming apparatus develops an electrostatic latent image formed on a photosensitive member using a developer (hereinafter referred to as toner) in a developing unit to form a toner image. Since there is a limit to an amount of toner which can be stored in the developing unit, toner is supplied as appropriate to the developing unit from a container which is detachably mounted to the image forming apparatus main body.

Japanese Patent Application Laid-Open No. 2010-256893 discusses a container which includes the following. The container includes a rotation unit which is rotatably driven, a pump unit configured to change internal pressure of a containing unit containing toner to discharge the toner from the containing unit, and a conversion unit configured to convert rotational movement of the rotation unit to expansion and contraction movement of the pump unit. The container expands and contracts the pump unit according to rotation of the container to discharge the toner inside the container. More specifically, air taken in from a discharge port according to expansion of the pump unit loosens the toner inside the containing unit. The containing unit then enters a negative pressure condition according to contraction of the pump unit, and the air inside the container pushes out the toner covering the discharge port from the discharge port.

However, it is necessary to control a rotational speed of the above-described container with high precision to precisely control the amount of toner to be discharged from the container.

SUMMARY OF THE INVENTION

The present invention is directed to an image forming apparatus capable of precisely controlling an amount of toner to be discharged from a container.

According to an aspect of the present invention, an image forming apparatus includes a developing unit configured to develop using toner an electrostatic latent image formed on a photosensitive member, a mounting unit to which a container including a containing unit configured to contain toner and a pump unit configured to change inner pressure of the containing unit is mounted, wherein the pump unit in the container contracts and expands according to rotation of the container, and the container supplies toner from the containing unit to the developing unit, a driving unit configured to rotate the container mounted to the mounting unit, a detection unit configured to detect a predetermined portion of the rotating container, and a controller configured to control the driving unit so that a rotational speed of the container becomes a predetermined speed, based on a detection result of the detection unit.

Further features of the present invention will become apparent from the following description of exemplary embodiments with reference to the mounted drawings.

DESCRIPTION OF THE EMBODIMENTS (Description of Image Forming Apparatus)

Figure 1:
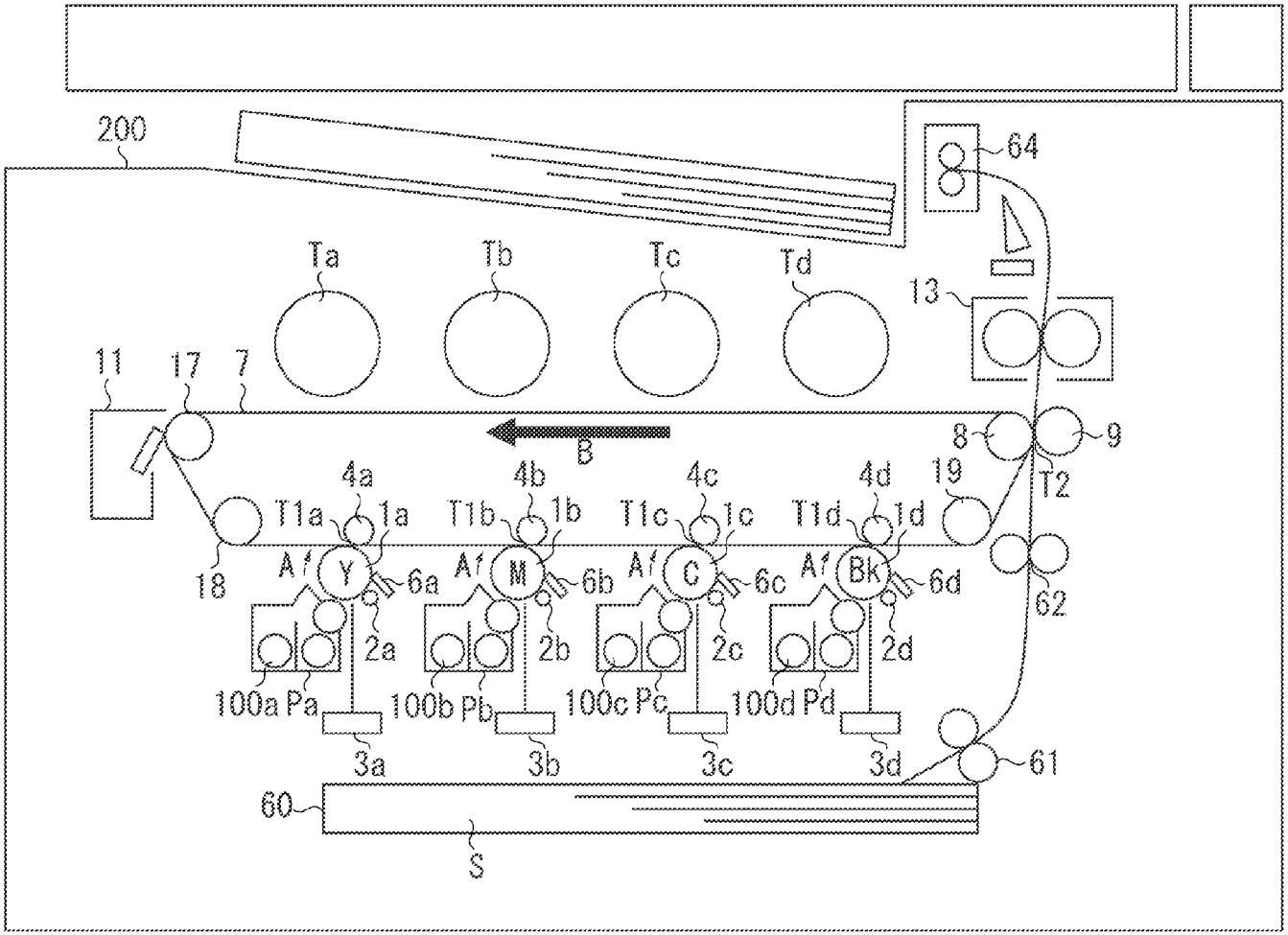
FIG. 1 is a schematic cross-sectional view illustrating an image forming apparatus.

FIG. 1 is a schematic cross-sectional view illustrating an image forming apparatus 200. Referring to FIG. 1, the image forming apparatus 200 includes four image forming units Pa, Pb, Pc, and Pd aligned in a conveyance direction of an intermediate transfer belt 7 to form toner images of respective color components. Further, toner bottles Ta, Tb, Tc, and Td are detachably mounted to the image forming apparatus 200. The toner bottle Ta contains yellow toner, the toner bottle Tb contains magenta toner, the toner bottle Tc contains cyan toner, and the toner bottle Td contains black toner. The toner bottles Ta, Tb, Tc, and Td are equivalents of a container which contains toner.

The image forming unit Pa forms a yellow toner image, the image forming unit Pb forms a magenta toner image, the image forming unit Pc forms a cyan toner image, and the image forming unit Pd forms a black toner image.

Since the configurations of the image forming units Pa, Pb, Pc, and Pd are similar, the image forming unit Pa which forms the yellow toner image will be described below. The description of the configurations of the other image forming units Pb, Pc, and Pd will thus be omitted.

The image forming unit Pa includes a photosensitive drum 1*a*, a charging unit 2*a* which charges the photosensitive drum 1*a*, and a developing unit 100*a* which contains toner. The photosensitive drum 1*a* includes a photosensitive layer functioning as a photosensitive member on a surface of a cylindrical metal roller. The photosensitive drum 1*a* rotates in a direction indicated by an arrow A illustrated in FIG. 1. After the photosensitive drum 1*a* has been charged by the charging unit 2*a*, a laser exposure device 3*a* exposes the photosensitive drum 1*a* based on image data of a yellow color component. As a result, an electrostatic latent image of the yellow color component is formed on the photosensitive drum 1*a*. The developing unit 100*a* then develops using the toner the electrostatic latent image formed on the photosensitive drum 1*a*. The toner image is thus formed on the photosensitive drum 1*a*. The developing unit 100*a* includes a sensor (not illustrated) which detects the amount of toner inside the developing unit 100*a*. If the sensor detects that the amount of toner inside the developing unit 100*a* has decreased, toner is supplied from the toner bottle Ta to the developing unit 100*a*.

The image forming unit Pa further includes a primary transfer roller 4*a* which transfers the toner image formed on the photosensitive drum 1*a* onto the intermediate transfer belt 7. A primary transfer voltage is applied to the primary transfer roller 4*a* while the toner image formed on the photosensitive drum 1*a* passes through a primary transfer nip portion T1*a* at which the photosensitive drum 1*a* and the intermediate transfer belt 7 are pressed by the primary transfer roller 4*a*. As a result, the toner image on the photosensitive drum 1*a* is transferred onto the intermediate transfer belt 7. The image forming unit Pa further includes a drum cleaner 6*a* which removes the toner remaining on the photosensitive drum 1*a*.

The intermediate transfer belt 7 is stretched around a secondary transfer counter roller 8, a driven roller 17, a first tension roller 18, and a second tension roller 19. The intermediate transfer belt 7 rotates in a direction indicated by an arrow B illustrated in FIG. 1 by rotational driving of the secondary transfer counter roller 8. That is, the toner image on the intermediate transfer belt 7 is conveyed in the direction indicated by the arrow B.

A secondary transfer roller 9 is disposed on the opposite side of the secondary transfer counter roller 8 with respect to the intermediate transfer belt 7. The secondary transfer counter roller 8 and the intermediate transfer belt 7 are pressed by the secondary transfer roller 9 at a secondary transfer nip portion T2. The toner image on the intermediate transfer belt 7 is thus transferred onto a recording material S at the secondary transfer nip portion T2 according to application of a secondary transfer voltage to the secondary transfer counter roller 8. A belt cleaner 11 removes the toner remaining on the intermediate transfer belt 7.

The recording material S onto which the toner image is transferred is stored in a cassette unit 60. A sheet feeding roller (not illustrated) feeds the recording material S stored in the cassette unit 60. A conveyance roller pair 61 conveys the recording material S fed by the sheet feeding roller (not illustrated) towards a registration roller pair 62. After the recording material S has been conveyed to the registration roller pair 62, the registration roller pair 62 conveys the recording material S so that the recording material S contacts the toner image on the intermediate transfer belt 7.

After the second transfer roller 9 has transferred the toner image onto the recording material S, the recording material S is conveyed to a fixing device 13. The fixing device 13 includes a fixing roller having a heater and a pressing roller, and fixes the toner image on the recording material S thereonto using heat of the heater and pressing forces of the fixing roller and the pressing roller. A discharge roller pair 64 discharges from the image forming apparatus 200 the recording material S on which the toner image has been fixed by the fixing device 13.

An image forming operation to be performed by the image forming apparatus 200 according to an exemplary embodiment will be described below. In the image forming operation, a print product is reproduced based on image data transferred from a personal computer (not illustrated) or a scanner (not illustrated).

The photosensitive drums 1*a*, 1*b*, 1*c*, and 1*d* start rotating in the direction indicated by the arrow A illustrated in FIG. 1. The charging units 2*a*, 2*b*, 2*c*, and 2*d* then uniformly charge the photosensitive drums 1*a*, 1*b*, 1*c*, and 1*d*, respectively. The laser exposure devices 3*a*, 3*b*, 3*c*, and 3*d* respectively expose the photosensitive drums 1*a*, 1*b*, 1*c*, and 1*d* based on the image data. As a result, the electrostatic latent images of respective color components of the image data are formed on the photosensitive drums 1*a*, 1*b*, 1*c*, and 1*d*. At the time, the sheet feeding roller (not illustrated) feeds the recording material S stored in the cassette unit 60, and the conveyance roller pair 61 starts to convey the recording material S towards the registration roller pair 62.

The developing units 100*a*, 100*b*, 100*c*, and 100*d* then develop the electrostatic latent images on the photosensitive drums 1*a*, 1*b*, 1*c*, and 1*d*, respectively, so that the toner images of the respective color components are formed on the photosensitive drums 1*a*, 1*b*, 1*c*, and 1*d*. The toner images formed on the photosensitive drums 1*a*, 1*b*, 1*c*, and 1*d* are respectively conveyed to the primary transfer nip portions T1*a*, T1*b*, T1*c*, and T1*d* along with the rotation of the photosensitive drums 1*a*, 1*b*, 1*c*, and 1*d* in the direction indicated by the arrow A. The toner images of the respective color components on the photosensitive drums 1*a*, 1*b*, 1*c*, and 1*d* are transferred to the intermediate transfer belt 7 at the primary transfer nip portions T1*a*, T1*b*, T1*c*, and T1*d*, respectively. More specifically, the primary transfer rollers 4*a*, 4*b*, 4*c*, and 4*d* transfer the respective toner images formed on the photosensitive drums 1*a*, 1*b*, 1*c*, and 1*d* to the intermediate transfer belt 7. A full-color toner image is thus formed on the intermediate transfer belt 7. The toner remaining on the photosensitive drums 1*a*, 1*b*, 1*c*, and 1*d* is removed by the respective drum cleaners 6*a*, 6*b*, 6*c*, and 6*d*.

The registration roller pair 62 adjusts timing of conveying the recording material S to the secondary transfer nip portion T2 so that the toner image on the intermediate transfer belt 7 is transferred to a desired position on the recording material S. The secondary transfer roller 9 thus transfers the toner image on the intermediate transfer belt 7 onto the recording material S at the secondary transfer nip portion T2. The belt cleaner 11 removes the toner which remains on the intermediate transfer belt 7 without being transferred onto the recording material S at the secondary transfer nip portion T2.

The recording material S bearing the toner image is conveyed to the fixing device 13, and the fixing device 13 then melt-fixes the unfixed toner image on the recording material S thereonto. After the recording material S passes through the fixing device 13, the discharge roller pair 64 discharges the recording material S from the image forming apparatus 200. As described above, the image forming apparatus 200 can reproduce the print product based on the image data by performing the above image forming operation.

(Configuration of Control Unit)

Figure 2:
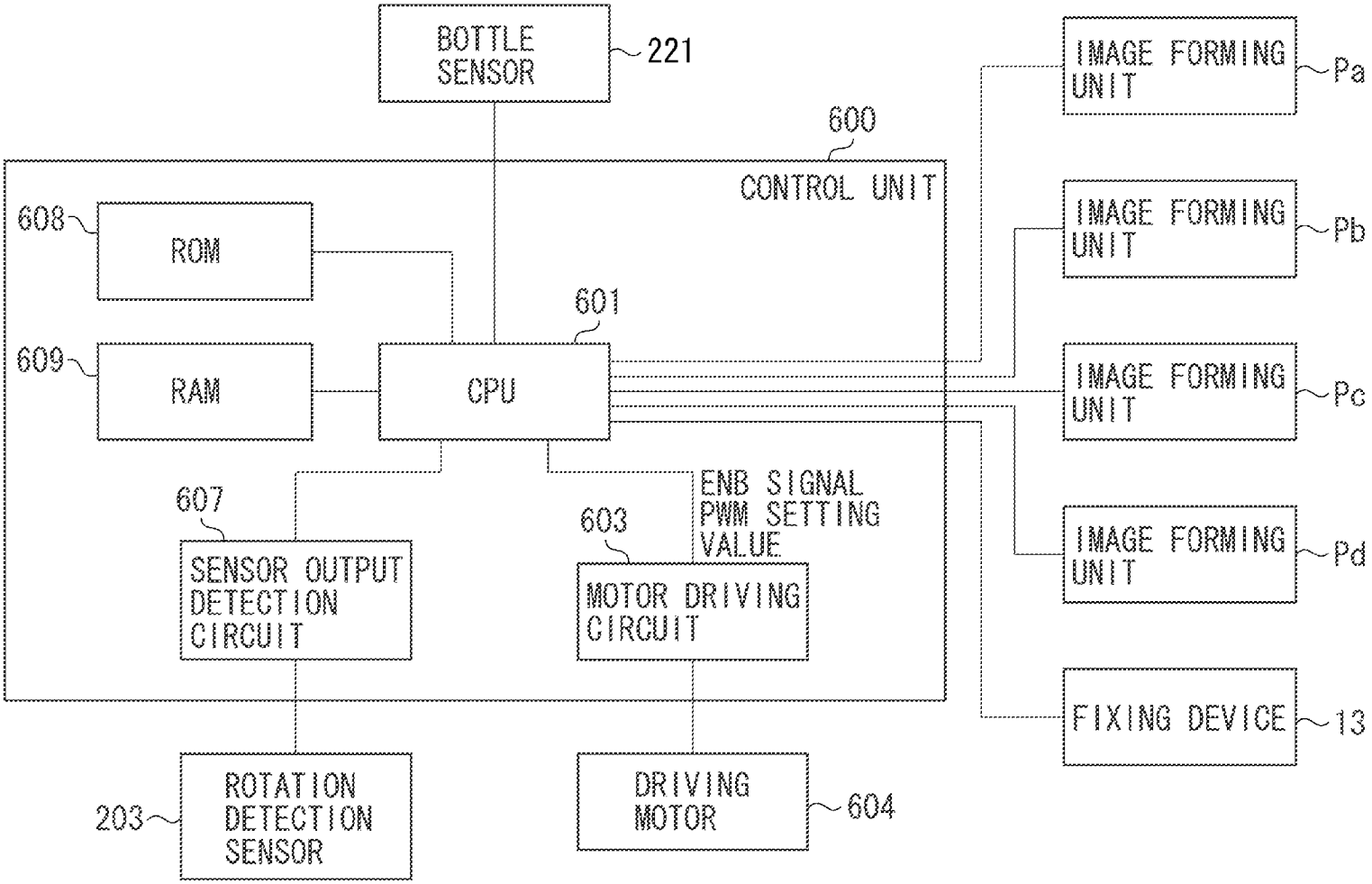
FIG. 2 is a block diagram of the image forming apparatus.

FIG. 2 is a control block diagram of the image forming apparatus 200 according to the present exemplary embodiment. Hereinafter, the toner bottles Ta, Tb, Tc, and Td will be referred to as the toner bottle T, and the developing units 100*a*, 100*b*, 100*c*, and 100*d* will be referred to as the developing unit 100.

Referring to FIG. 2, a control unit 600 controls the entire image forming apparatus 200. The control unit 600 includes a central processing unit (CPU) 601, a motor driving circuit 603, a sensor output detection circuit 607, a read-only memory (ROM) 608, and a random access memory (RAM) 609.

The CPU 601 is a control circuit configured to control each device in the image forming apparatus 200. The ROM 608 stores a control program for controlling each processing to be executed in the image forming apparatus 200. The RAM 609 is a system work memory to be used by the CPU 601 for executing the control program. Since the image forming units Pa, Pb, Pc, and Pd and the fixing device 13 are described above with reference to FIG. 1, further description will be omitted. Further, a bottle sensor 221 detects whether the toner bottle T has been mounted to a mounting position in the image forming apparatus 200, and outputs a detection result to the CPU 601.

A driving motor 604 is a driving source which rotates the toner bottle T for supplying the toner from the toner bottle T to the developing unit 100. The motor driving circuit 603 controls a current to be supplied to the driving motor 604 to control the driving motor 604. The CPU 601 sets a pulse width modulation (PWM) setting value, that is, a control value indicating a ratio of the time for which the current is to be supplied to the driving motor 604 per unit time. The motor driving circuit 603 thus controls the current to be supplied to the driving motor 604 based on the PWM setting value. According to the present exemplary embodiment, a direct current (DC) motor (i.e., a brushed DC motor) is used as the driving motor 604. Accordingly, a rotational speed and a rotational driving force of the driving motor 604 change according to the ratio of the time for which the current is supplied to the driving motor 604 per unit time.

The motor driving circuit 603 can supply the current to the driving motor 604 while the CPU 601 is outputting an ENB signal. More specifically, the motor driving circuit 603 supplies the current based on the PWM setting value to the driving motor 604 while the CPU 601 is outputting the ENB signal. As a result, the toner bottle T is rotationally driven. On the other hand, if the CPU 601 stops outputting the ENB signal, the motor driving circuit 603 stops supplying the current to the driving motor 604, so that the toner bottle T stops rotating.

A rotation detection sensor 203 is an optical sensor including a light emitting unit and a light receiving unit, and outputs a signal according to the amount of light received by the light receiving unit. While a predetermined area of the toner bottle T is passing through a detection position, the light receiving amount of the rotation detection sensor 203 decreases to less than a threshold value. Further, while an area other than the predetermined area of the toner bottle T is passing through the detection position in a rotational direction of the toner bottle T, the light receiving amount of the rotation detection sensor 203 becomes equal to or greater than the threshold value. The configuration of the rotation detection sensor 203 will be described in detail below with reference to FIGS. 4A, 4B, and 4C.

The sensor output detection circuit 607 outputs a signal based on an output signal from the rotation detection sensor 203. More specifically, if the light receiving amount of the rotation detection sensor 203 is equal to or greater than the threshold value, the sensor output detection circuit 607 outputs a high-level signal. If the light receiving amount of the rotation detection sensor 203 is less than the threshold value, the sensor output detection circuit 607 outputs a low-level signal. In other words, the sensor output detection circuit 607 outputs the low-level signal while the predetermined area of the toner bottle T is passing through the detection position, and outputs the high-level signal while the area other than the predetermined area of the toner bottle T is passing through the detection position.

(Description of Mounting Unit)

Figure 3A:
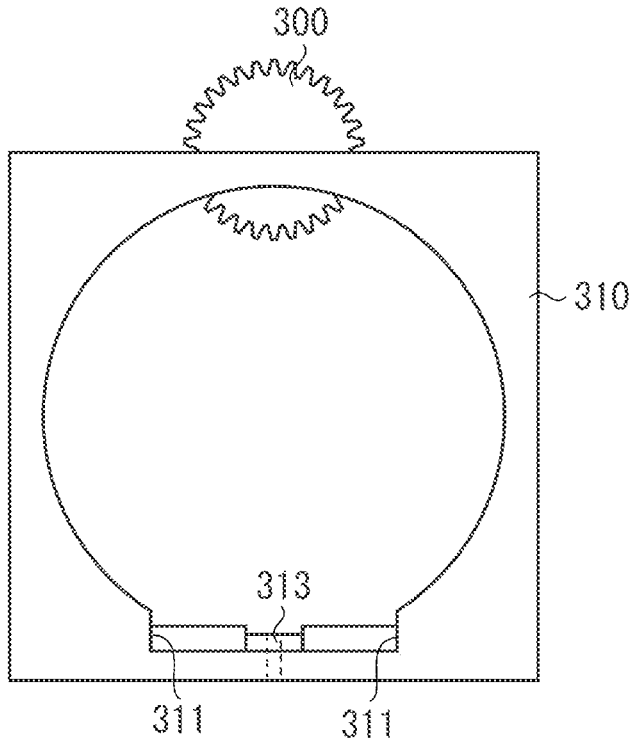
FIGS. 3A and 3B are schematic views illustrating main portions of a mounting unit of a toner bottle.
Figure 3B:
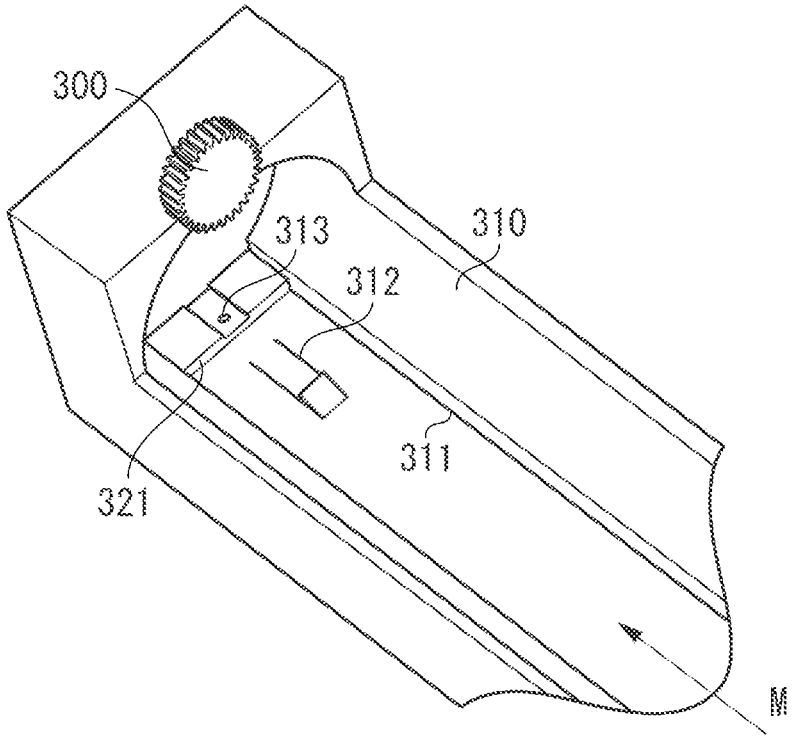

The toner bottle T is mounted to a mounting unit 310 disposed in the image forming apparatus 200. The configuration of the mounting unit 310 will be described below with reference to FIGS. 3A and 3B. FIG. 3A is a partial front view illustrating the mounting unit 310 viewed from the front in a mounting direction of the toner bottle T. FIG. 3B is a perspective view illustrating an interior of the mounting unit 310. The toner bottle T is mounted to the mounting unit 310 in a direction indicated by an arrow M illustrated in FIG. 3B. The direction indicated by the arrow M is parallel to a direction of an axis line of rotation of the photosensitive drums 1*a*, 1*b*, 1*c*, and 1*d* in the image forming apparatus 200. Further, a direction in which the toner bottle T is dismounted from the mounting unit 310 is an opposite direction to the direction indicated by the arrow M.

The mounting unit 310 includes a drive gear 300, a rotational direction regulating unit 311, a bottom portion 321, and a rotational axis line direction regulating unit 312. The drive gear 300 is connected to a rotational shaft of the driving motor 604. The rotational direction regulating unit 311 controls a cap portion 222 (illustrated in FIGS. 4A, 4B, and 4C to be described below) of the toner bottle T not to rotate according to rotation of the toner bottle T. The rotational axis line direction regulating unit 312 locks the cap portion 222 of the toner bottle T to regulate the movement of the cap portion 222 in the rotational axis line direction.

The bottom portion 321 includes a receiving port (i.e., a receiving hole) 313. More specifically, when the toner bottle T is mounted, the receiving port 313 communicates with a discharge port (i.e., a discharge hole) 211 (illustrated in FIGS. 4B and 4C) of the toner bottle T to receive the toner discharged from the toner bottle T. The toner discharged from the discharge port 211 passes through the receiving port 313 and is supplied to the developing unit 100. According to the present exemplary embodiment, a diameter of the receiving port 313 is the same as that of the discharge port 211 and is approximately 2 mm, for example.

Figure 4A:
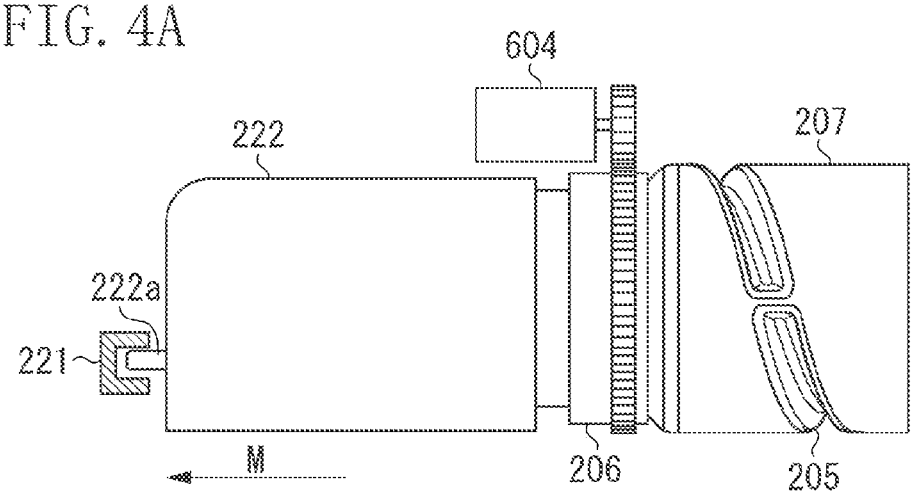
FIGS. 4A, 4B, and 4C are schematic views illustrating main portions of the toner bottle.
Figure 4B:
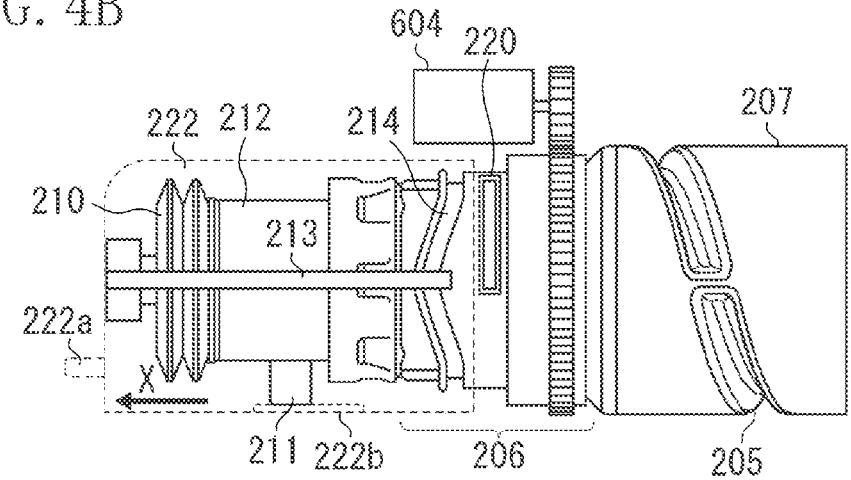
Figure 4C:
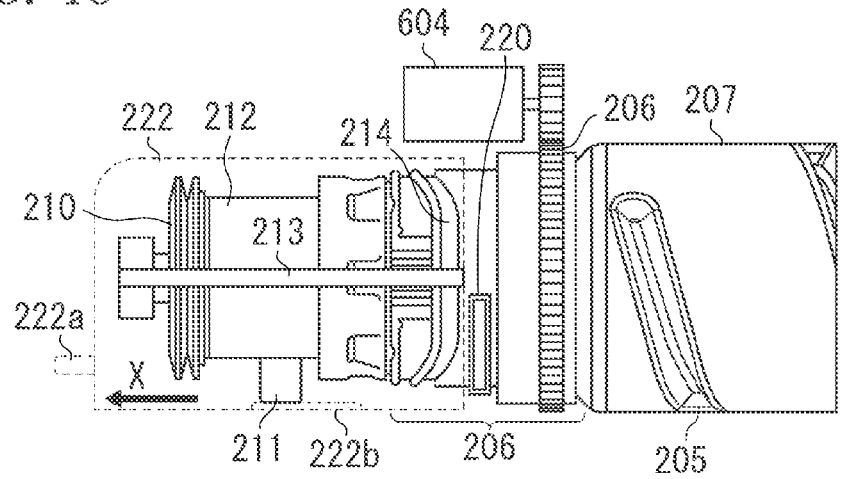

The drive gear 300 is fixed to the rotational shaft of the driving motor 604 (as illustrated in FIGS. 4A, 4B, and 4C). The drive gear 300 transmits the rotational driving force from the driving motor 604 to the toner bottle T mounted to the mounting unit 310.

(Description of Toner Bottle)

FIG. 4A is an external view illustrating the toner bottle T mounted to the mounting unit 310. FIGS. 4B and 4C are schematic views illustrating the configuration inside the cap portion 222 of the toner bottle T mounted to the mounting unit 310.

Referring to FIGS. 4A, 4B, and 4C, the toner bottle T includes a containing unit 207, a drive transmission unit 206, a discharge unit 212, and a pump unit 210. The containing unit 207 contains the toner. The rotational driving force from the driving motor 604 is transmitted to the drive transmission unit 206. The discharge unit 212 includes the discharge port 211 which discharges toner. The pump unit 210 is used for discharging the toner inside the discharge unit 212 from the discharge port 211. The toner bottle T further includes a reciprocating member 213 which causes the pump unit 210 to expand and contract. The drive transmission unit 206 includes a projection portion 220 (i.e., a predetermined portion) and a cam groove 214. The cam groove 214 is formed over an entire circumference of the drive transmission unit 206 in the rotational direction of the drive transmission unit 206 of the toner bottle T.

The cam groove 214 and the projection portion 220 formed on the drive transmission unit 206 rotate together with the drive transmission unit 206. The driving motor 604 transmits the rotational driving force to the drive transmission unit 206 of the toner bottle T via the drive gear 300, thereby rotating the drive transmission unit 206 of the toner bottle T and the containing unit 207 connected to the drive transmission unit 206. A concave portion 205 is spirally formed inside the containing unit 207, and conveys the toner inside the containing unit 207 towards the discharge port 211 along with rotation of the containing unit 207.

On the other hand, since the rotation of the cap portion 222 is regulated by the mounting unit 310, the cap portion 222 does not rotate even if the drive transmission unit 206 rotates. The toner discharge port 211, the pump unit 210, and the reciprocating member 213 are also controlled not to rotate along with the cap portion 222. The toner discharge port 211, the pump unit 210, and the reciprocating member 213 therefore do not rotate even if the drive transmission unit 206 rotates.

A rotation regulating groove formed inside the cap portion 222 controls the reciprocating member 213 not to rotate according to the rotation of the drive transmission unit 206. The reciprocating member 213 is thus engaged with the rotation regulating groove (refer to FIG. 5). Further, the reciprocating member 213 is connected to the pump unit 210, and a claw portion (not illustrated) thereof is engaged with the cam groove 214 of the drive transmission unit 206. As a result, the reciprocating member 213 moves along the cam groove 214 while being controlled not to rotate according to the rotation of the drive transmission unit 206. The reciprocating member 213 thus reciprocates in a direction indicated by an arrow X illustrated in FIGS. 4B and 4C (i.e., in a longitudinal direction of the toner bottle T).

As described above, the reciprocating member 213 is connected to the pump unit 210. When the reciprocating member 213 reciprocates, the pump unit 210 alternately repeats expansion and contraction. If the reciprocating member 213 moves in the direction of the arrow X, the pump unit 210 expands. The expansion of the pump unit 210 decreases the internal pressure of the toner bottle T, so that the air is taken in from the discharge port 211 and loosens the toner inside the discharge unit 212. Further, if the reciprocating member 213 moves in the opposite direction to the direction indicated by the arrow X, the pump unit 210 contracts. The contraction of the pump unit 210 increases the internal pressure of the toner bottle T, so that the toner accumulated on the discharge port 211 is supplied from the discharge port 211 to the developing unit 100 through a toner conveyance path.

The cap portion 222 includes a protrusion 222*a* on a rear side in the mounting direction (indicated by the arrow M illustrated in FIG. 4A) of the toner bottle T. The bottle sensor 221 provided in the image forming apparatus 200 detects that the toner bottle T is mounted to the mounting unit 310. If the toner bottle T is mounted to the mounting position, the bottle sensor 221 outputs to the CPU 601*a* signal indicating that the toner bottle T is mounted upon detecting the protrusion 222*a* on the cap portion 222.

The cap portion 222 further includes a sealing member 222*b* which seals the discharge port 211. If the discharge port 211 is sealed by the sealing member 222, the toner in the toner bottle T is prevented from leaking from the discharge port 211. If a user removes the sealing member 222*b* before the toner bottle T is mounted to the mounting unit 310, the discharge port 211 of the toner bottle T is opened.

FIG. 4B is a cross-sectional view illustrating main portions of the toner bottle T in a state where the pump unit 210 of the toner bottle T has fully expanded. Further, FIG. 4C is a cross sectional view illustrating the main portions of the toner bottle T in a state where the pump unit 210 of the toner bottle T has fully contracted. The pump unit 210 is a bellows-shaped pump formed of resin, and a volume thereof changes along with expansion and contraction thereof. In other words, the pump unit 210 has upward folded portions and downward folded portions alternately and repeatedly aligned along the longitudinal direction of the toner bottle T.

According to the present exemplary embodiment, a toner supplying operation is performed twice over one rotation of the toner bottle T. One toner supplying operation starts from a state where the pump unit 210 has fully contracted, the pump unit 210 then expands and contracts, and the operation ends in a state where the pump unit 210 has fully contracted.

Two peak portions and two valley areas are formed in the cam groove 214 in an order of valley, peak, valley, and peak. If the position at which the reciprocating member 213 is engaged with the cam groove 214 is the peak portion, the pump unit 210 becomes fully expanded. If the position at which the reciprocating member 213 is engaged with the cam groove 214 is the valley area, the pump unit 210 becomes fully contracted.

(Configuration of Rotation Detection Sensor)

Figure 5:
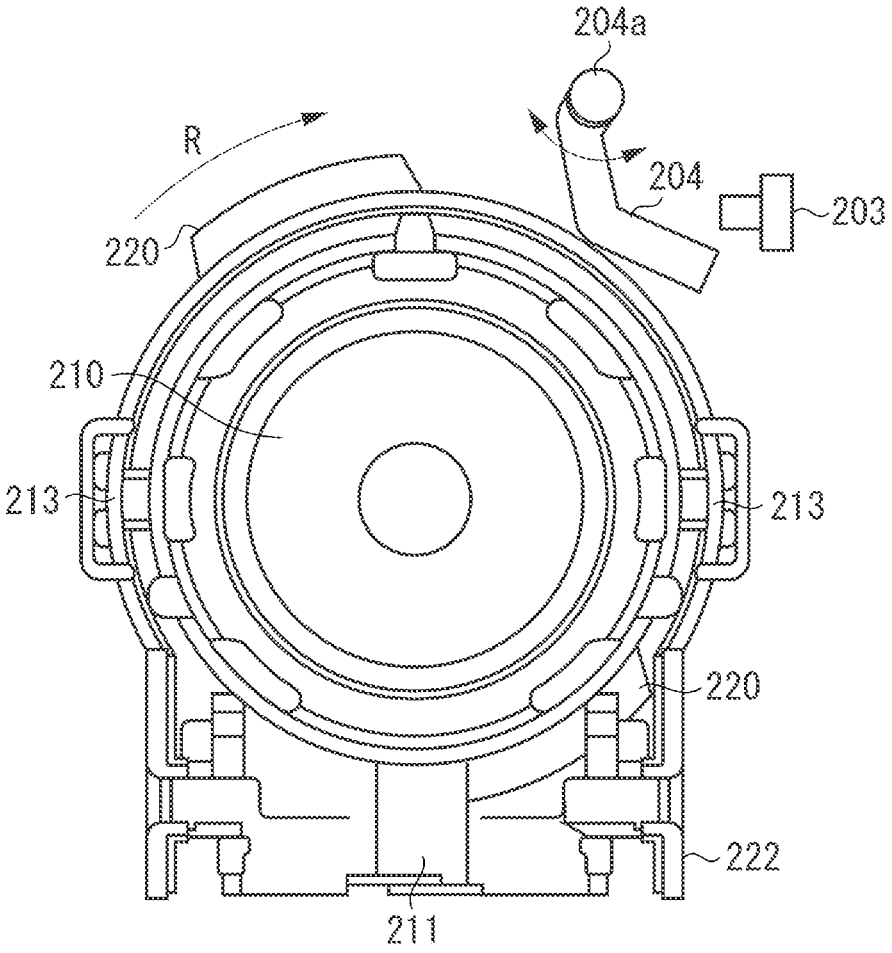
FIG. 5 is a schematic view illustrating main portions of a rotation detection sensor.
Figure 6:
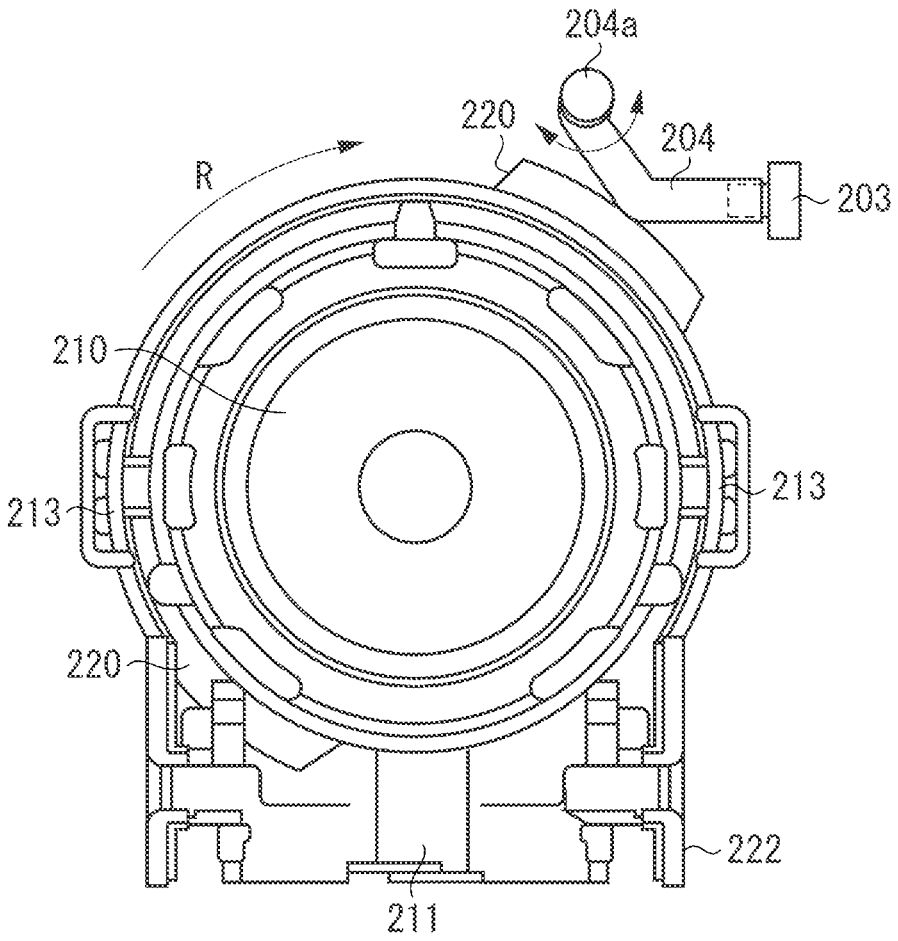
FIG. 6 is a schematic view illustrating main portions of the rotation detection sensor.

The rotation detection sensor 203 disposed in the image forming apparatus 200 will be described below with reference to FIGS. 5 and 6. The rotation detection sensor 203 is an optical sensor including the light emitting unit and the light receiving unit which receives the light emitted from the light emitting unit. Referring to FIGS. 5 and 6, a flag (a sensor flag) 204 contacts the drive transmission unit 206 of the toner bottle T due to its own weight. As a result, the flag 204 is pushed by the projection portion 220 of the drive transmission unit 206, swings around a rotational axis 204*a*, and blocks the light emitted from the light emitting unit. In other words, the rotation detection sensor 203 can detect whether the flag 204 is in contact with the projection portion 220, that is, the rotation detection sensor 203 can detect the rotational position of the toner bottle T. FIG. 5 illustrates the flag 204 contacting a position overlapping an area in which the projection portion 220 is formed in the direction in which the toner bottle T is to be mounted and an area different from the projection portion 220 (i.e., another area) in the rotational direction of the drive transmission unit 206. In such a case, the flag 204 is not positioned between the light emitting unit and the light receiving unit, so that the light receiving unit can receive the light emitted from the light emitting unit. According to the present exemplary embodiment, if the flag 204 is not positioned between the light emitting unit and the light receiving unit, the light receiving amount of the light receiving unit becomes equal to or greater than the threshold value. Further, according to the present exemplary embodiment, if the light receiving amount of the light receiving unit becomes equal to or greater than the threshold value, the sensor output detection circuit 607 (illustrated in FIG. 2) outputs the high-level signal (i.e., a logic 'H'). On the other hand, if the light receiving amount of the light receiving unit is less than the threshold value, the sensor output detection circuit 607 outputs the low-level signal (i.e., a logic 'L'). In other words, if the flag 204 is in contact with the area other than the projection portion 220, the sensor output detection circuit 607 outputs the high-level signal (i.e., a logic 'H') to the CPU 601.

On the other hand, FIG. 6 illustrates the flag 204 being in contact with the projection portion 220. In such a case, the flag 204 is positioned between the light emitting unit and the light receiving unit, so that the light receiving unit cannot receive the light emitted from the light emitting unit. The light receiving amount of the light receiving unit thus becomes less than the threshold value. In other words, if the flag 204 is in contact with the projection portion 220, the sensor output detection circuit 607 outputs the low-level signal (i.e., the logic 'L') to the CPU 601.

According to the present exemplary embodiment, the rotation detection sensor 203 is configured so that the projection portion 220 pushes up the flag 204 from when the pump unit 210 starts contracting to when the pump unit 210 has fully contracted. The sensor output detection circuit 607 outputs the low-level signal (i.e., the logic 'L') from when the pump unit 210 starts contracting to when the pump unit 210 has fully contracted. The sensor output detection circuit 607 then outputs the high-level signal (i.e., the logic 'H') from when the pump unit 210 starts expanding to when the pump unit 210 has fully expanded.

(Rotational Speed Control Processing)

According to the present exemplary embodiment, the DC motor (the brushed DC motor) is used as the driving motor 604. When the driving motor 604 rotationally drives the toner bottle T, the rotational speed of the toner bottle T changes according to the weight of the toner bottle T. More specifically, if the amount of toner contained in the toner bottle T becomes small as a result of the toner being supplied from the toner bottle T to the developing unit 100, the toner bottle T becomes light. As a result, if the driving motor 604 which is driven based on a predetermined PWM setting value rotates the toner bottle T, the rotational speed of the toner bottle T becomes greater than a target speed.

Figure 9:
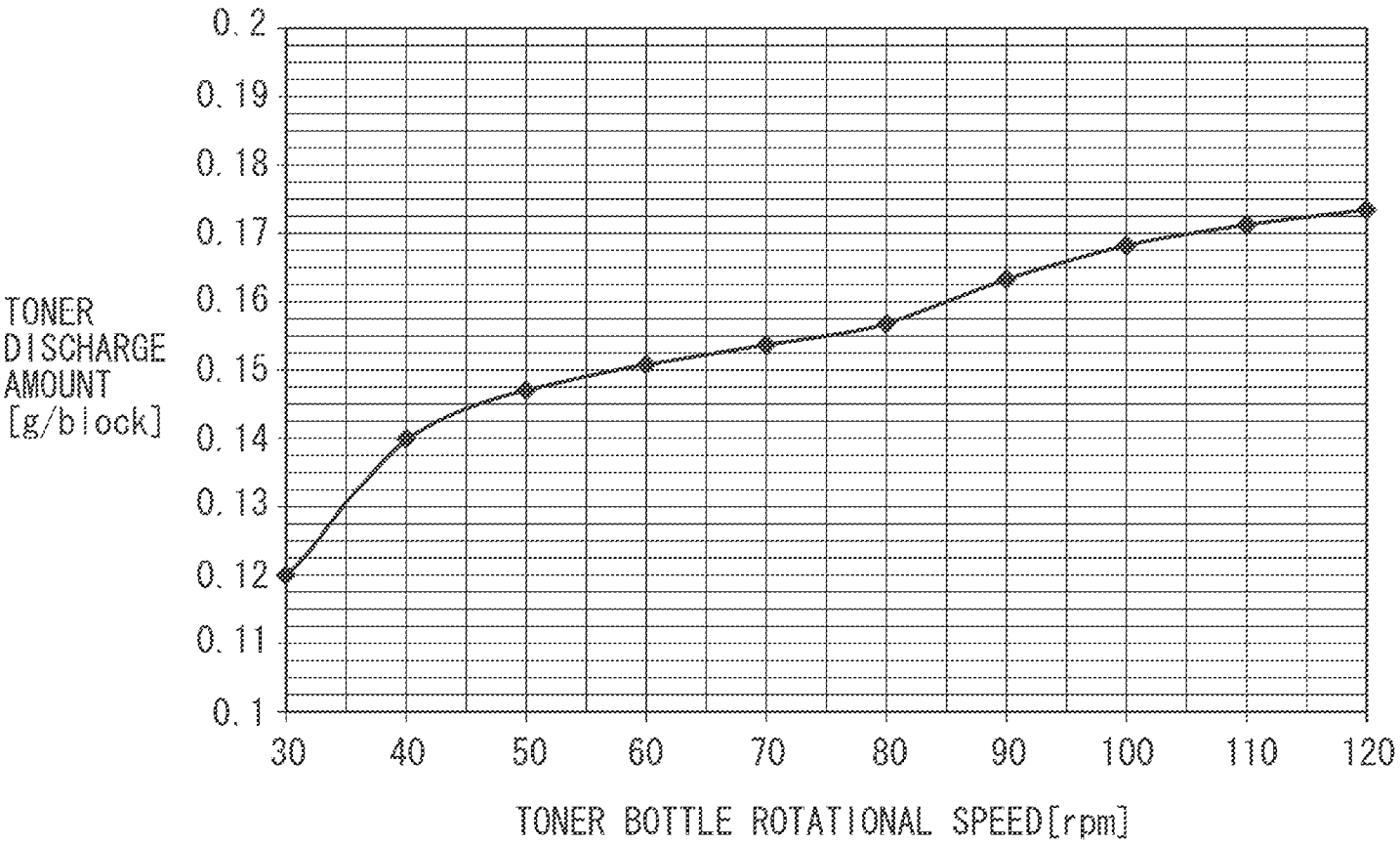
FIG. 9 illustrates a relation between a rotational speed of the toner bottle and a toner discharge amount.

It has been revealed through experiments that the amount of toner supplied from the toner bottle T to the developing unit 100 (i.e. a supply amount) varies according to the speed at which the internal pressure of the toner bottle T changes. In other words, if the rotational speed of the toner bottle T becomes greater than the target speed due to the decrease in the weight of the toner bottle T, the supply amount of the toner bottle T becomes greater than a target supply amount. FIG. 9 illustrates the relation between the rotational speed of the toner bottle T and the amount of toner discharged from the toner bottle T at one time (i.e., a toner discharge amount) obtained from measurement results of the experiments. Referring to FIG. 9, as the rotational speed of the toner bottle T increases, the amount of toner discharged from the toner bottle T at one time increases. Specifically, the toner discharge amount when the rotational speed of the toner bottle T is 120 rpm is greater by 40% as compared to the toner discharge amount when the rotational speed of the toner bottle T is 30 rpm. In a case where the image forming apparatus is configured so that the toner is directly supplied from the toner bottle T to the developing unit 100, if the toner discharge amount changes by as much as 40%, density of the print product may change.

According to the present exemplary embodiment, one toner supplying operation starts from the state where the pump unit 210 has fully contracted, the pump unit 210 then expands and contracts, and the toner supplying operation ends in the state where the pump unit 210 has fully contracted. As illustrated in FIG. 9, the toner supply amount is influenced by the rotational speed when the pump unit 210 contracts. To solve such a problem, according to the present exemplary embodiment, the position in a start state (i.e., an end state of the previous toner supplying operation) is designed so that the DC motor (i.e., the brushed DC motor) is stabilized at the target rotational speed before the pump unit 210 starts contracting.

Further, according to the present exemplary embodiment, the rotational speed of the toner bottle T is feedback-controlled, so that the change in the rotational speed of the toner bottle T according to the change in the weight of the toner bottle T is reduced.

If feedback control is to be performed with high precision, it is necessary to precisely measure the rotational speed of the toner bottle T. The DC motor (the brushed DC motor) is characterized in that it takes time for the rotational speed to rise to the target rotational speed and for the DC motor to stop rotating. Accordingly, it is necessary to detect the timing at which the DC motor (the brushed DC motor) becomes stabilized at the target rotational speed to measure the rotational speed.

As described above, according to the present exemplary embodiment, the DC motor (the brushed DC motor) is designed to be stabilized at the target rotational speed before the pump unit 210 starts contracting. The rotational speed is thus measured at the timing when the pump unit 210 is contracting.

Further, the width of the valley area of the cam groove 214 is greater than the width of the peak area of the cam groove 214, so that the rotation of the toner bottle T stops in a state where the pump unit 210 has fully contracted. As a result, the possibility of the toner bottle T stopping to rotate in the state where the pump unit 210 has not fully contracted is reduced.

Figure 7:
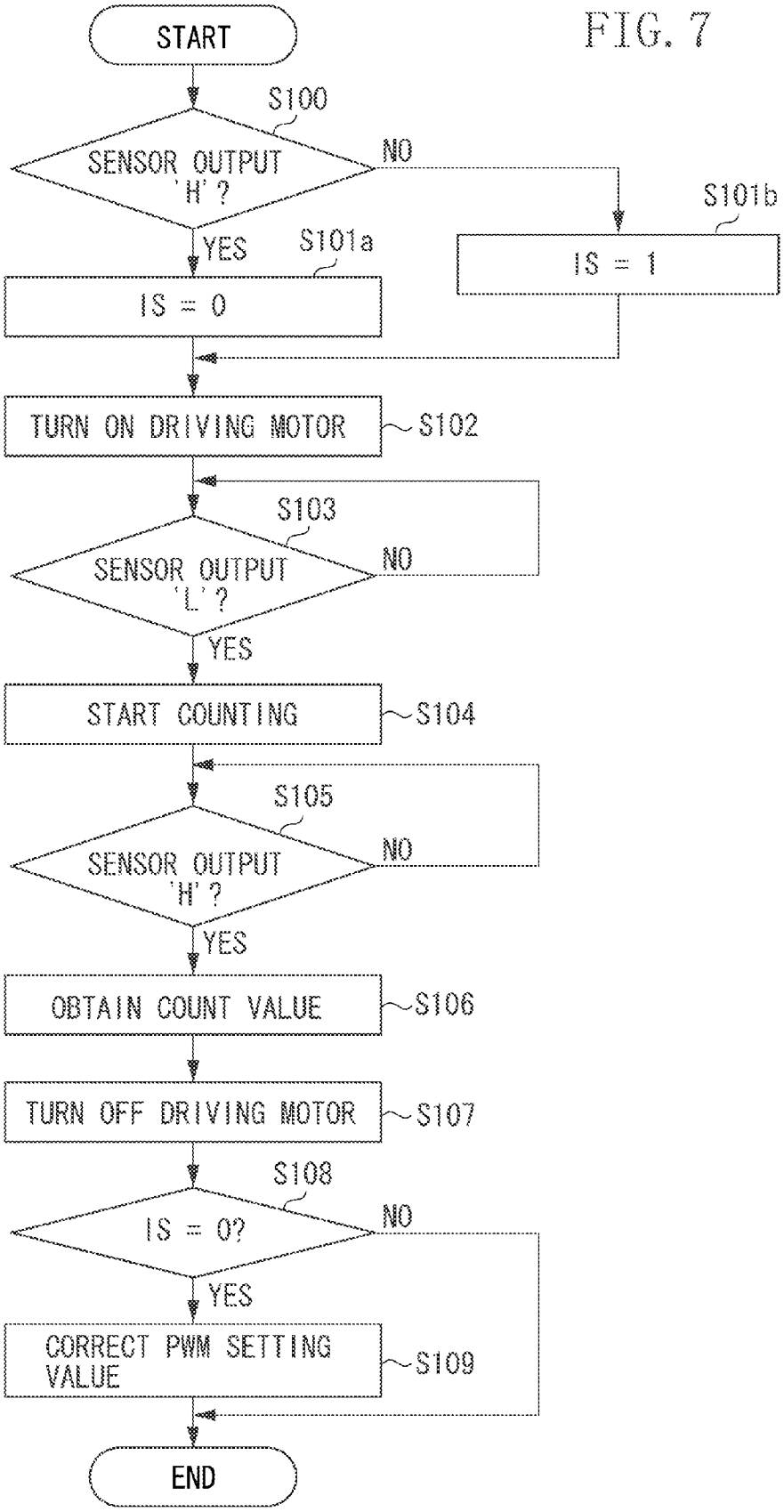
FIG. 7 is a flowchart illustrating rotational speed control processing.

The rotational speed control processing in which the CPU 601 controls rotation of the driving motor 604 so that the rotational speed of the driving motor 604 becomes the target speed will be described below with reference to the control block diagram illustrated in FIG. 2 and the flowchart illustrated in FIG. 7. The rotational speed control processing illustrated in FIG. 7 is executed by the CPU 601 reading the program stored in the ROM 608. According to the present exemplary embodiment, if the toner is to be supplied from the toner bottle T to the developing unit 100, the CPU 601 performs the rotational speed control processing illustrated in FIG. 7. In other words, the CPU 601 performs the rotational speed control processing illustrated in FIG. 7 based on a toner supply instruction. It is sufficient for the CPU 601 to perform the toner supplying operation for supplying toner from the toner bottle T to the developing unit 100 if the toner amount of the developing unit 100 becomes less than a predetermined amount.

In step S100, the CPU 601 determines whether the signal output from the sensor output detection circuit 607 is the high-level signal (i.e., the logic 'H'). The CPU 601 determines whether the toner bottle T has been stopped in the state where the pump unit 210 has contracted, based on the signal output from the sensor output detection circuit 607. In other words, the CPU 601 determines whether the current toner supplying operation can be started from the appropriate rotational position.

If the signal output from the sensor output detection circuit 607 is the high-level signal (YES in step S100), the CPU 601 determines that rotational driving of the toner bottle T has stopped after the pump unit 210 has fully contracted. The processing then proceeds to step S101*a*, and the CPU 601 sets the value of an error flag IS to 0.

On the other hand, if the signal output from the sensor output detection circuit 607 is the low-level signal (NO in step S100), the CPU 601 determines that the rotation of the toner bottle T has stopped while the pump unit 210 is contracting. If the signal output from the sensor output detection circuit 607 is the low-level signal (NO in step S100), the processing then proceeds to step S101*b*, and the CPU 601 sets the value of the error flag IS to 1.

In step S102, the CPU 601 sets the PWM setting value stored in the RAM 609 to the motor driving circuit 603, and outputs the ENB signal to the motor driving circuit 603. If the PWM setting value is not stored in the RAM 609, the CPU 601 sets a predetermined value, for example, as the PWM setting value.

After the rotational driving of the driving motor 604 has been started, the processing proceeds to step S103. In step S103, the CPU 601 stands by until the sensor output detection circuit 607 outputs the low-level signal (i.e., the logic 'L').

If the CPU 601 determines that the sensor output detection circuit 607 has output the low-level signal (YES in step S103), the processing proceeds to step S104.

In step S104, the CPU 601 starts counting according to a predetermined clock signal in response to the sensor output detection circuit 607 outputting the low-level signal. Next, the processing proceeds to step S105. In step S105, the CPU 601 stands by until the sensor output detection circuit 607 outputs the high-level signal (i.e., the logic 'H'). If the CPU 601 determines that the signal output from the sensor output detection circuit 607 has changed from the low-level signal to the high-level signal (YES in step S105), the processing proceeds to step S106. In step S106, the CPU 601 obtains a current count value Tn. Then, the processing proceeds to step S107. In step S107, the CPU 601 stops the rotational driving of the driving motor 604.

The count value Tn is the time measured from when a leading edge of the projection portion 220 in the rotational direction of the toner bottle T has pushed up the sensor flag 204 to when a trailing edge of the projection portion 220 in the rotational direction has released the pushing up of the sensor flag 204. In other words, the count value Tn is the value obtained by measuring the time for which the sensor flag 204 has been pushed up by the projection portion 220. According to the present exemplary embodiment, when the pump unit 210 ends contracting, the signal output from the sensor output detection circuit 607 changes from low-level to high-level. As a result, the CPU 601 determines that the toner supplying operation for supplying toner from the toner bottle T to the developing unit 100 has been performed once. The CPU 601 then stops inputting the ENB signal to the motor driving circuit 603. The driving motor 604 thus stops. By per toner supplying operation, a constant amount of toner (1 block) is supplied.

The CPU 601 measures the time for which the low-level signal has been output from the sensor output detection circuit 607 in the processes performed from step S103 to step S106. According to the present exemplary embodiment, a period for which the signal output from the sensor output detection circuit 607 is the low-level signal corresponds to the period for which the flag 204 is in contact with the projection portion 220 along with rotation of the toner bottle T.

After the CPU 601 has stopped the rotational driving of the driving motor 604, the processing proceeds to step S108. In step S108, the CPU 601 determines whether the value of the error flag IS is 0.

If the value of the error flag IS is 0 (YES in step S108), the current toner supplying operation has been started from the appropriate rotational position. In other words, it indicates that the count value Tn measured by performing the current toner supplying operation is reliable. Then, the processing proceeds to step S109. In step S109, the CPU 601 thus corrects the PWM setting value stored in the RAM 609, based on the count value Tn, and ends the rotational speed control processing.

The CPU 601 corrects the PWM setting value as follows. The CPU 601 obtains a rotational speed V (n) of the current toner supplying operation from the count value Tn. The count value Tn indicates the time in which the flag 204 has been in contact with the projection portion 220. Since a peripheral length of the projection portion 220 is known, the rotational speed V (n) of the current toner supplying operation can be obtained based on the count value Tn.

The CPU 601 then calculates a correction value D (n+1) of the PWM setting value based on the following equation.

$$D(n+1)=D(n)+Ki*(Vtgt-V(n))$$

In the above-described equation, D (n) is the current PWM setting value (i.e., the PWM setting value set in step S102), Ki is a predetermined proportional constant, and Vtgt is the target rotational speed.

The correction value D (n+1) of the PWM setting value is used in the subsequent toner supplying operation.

On the other hand, if the error flag IS is 1 (NO in step S108), the current toner supplying processing has not been started from the appropriate rotational position. In other words, it is likely that the rotational speed of the DC motor (the brushed DC motor) is still rising to the target rotational speed while the flag 204 is in contact with the projection portion 220. It thus indicates that the count value Tn measured by performing the current toner supplying processing is unreliable. The CPU 601 therefore ends the rotational speed control processing without correcting the PWM setting value.

As described above, according to the present exemplary embodiment, the count value is obtained and the driving motor is stopped in response to the signal output from the sensor output detection circuit 607 changing from low-level to high-level. According to the present exemplary embodiment, the detection timing of the trailing edge portion of the protrusion portion 220 in the rotational direction of the toner bottle T is designed to correspond to the timing at which contraction of the pump unit 210 ends. The detection result of the trailing edge portion of the protrusion portion 220 is used as an index indicating both the end of a measuring period of the rotational speed and the end of the toner supplying operation. As a result, the configuration of the projection portion 220 disposed in the drive transmission unit 206 can be simplified, and control performed by the CPU 601 can also be simplified.

According to the present exemplary embodiment, the PWM setting value which controls the rotational speed of the driving motor 604 is corrected based on the time when the rotation detection sensor 203 detects the projection portion 220 of the toner bottle T. The rotational speed of the toner bottle T can thus be controlled to reach the target rotational speed. In other words, the time for which the toner supplying operation has been performed from when the pump unit 210 has started contracting to when the pump unit 210 has fully contracted is measured. The rotational speed at which the toner bottle T is subsequently rotated is then controlled based on the measurement result. As a result, the rotational speed of the toner bottle T can be controlled to reach the target rotational speed, so that the toner discharge amount of the toner bottle T can be stabilized.

(Transition of Rotational Speed of Driving Motor)

Figure 8:
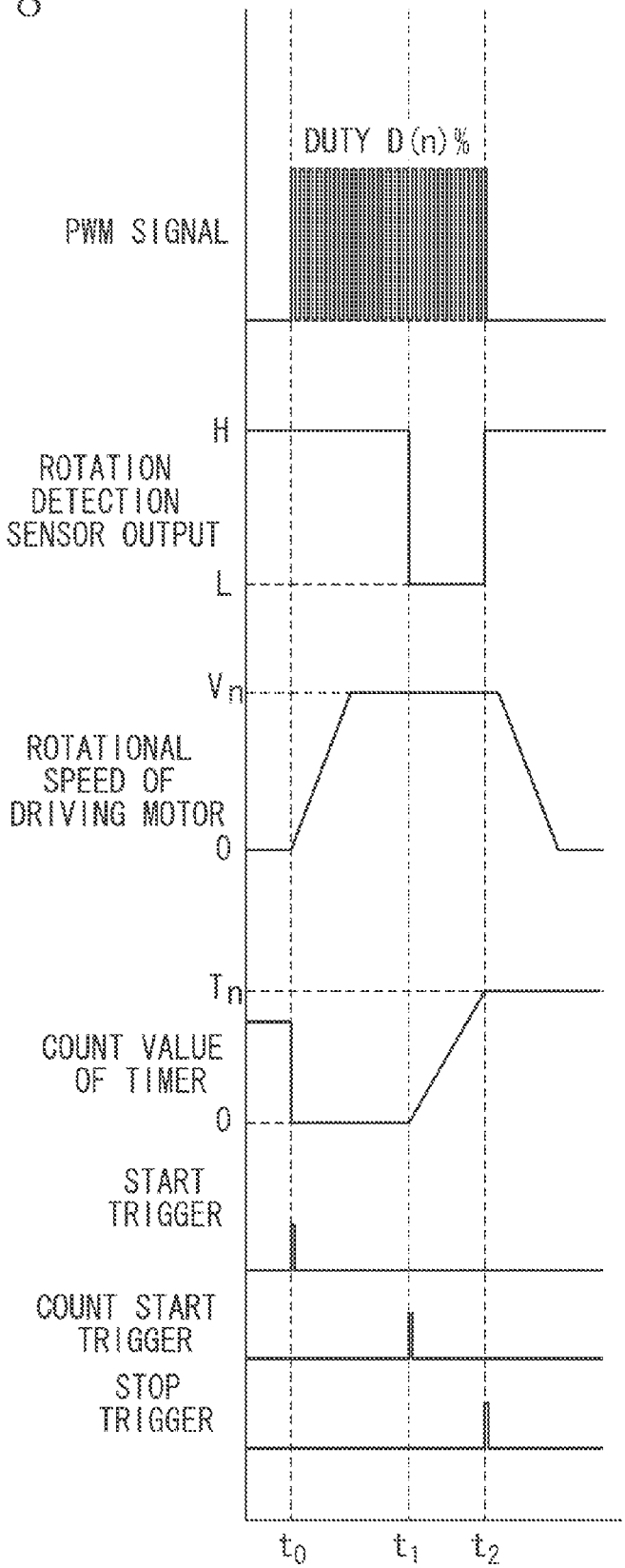
FIG. 8 is a timing chart.

FIG. 8 is a timing chart illustrating the PWM setting value, the output signal from the sensor output detection circuit 607, the rotational speed of the driving motor 604, the count value Tn, a start signal for starting the toner supplying operation, a count start signal indicating count start, and a stop signal for stopping the toner supplying operation.

If the toner is to be supplied from the toner bottle T to the developing unit 100 at a time t0, the CPU 601 outputs the start signal at the time t0. Upon outputting the start signal, the CPU 601 starts controlling the time for which the motor driving circuit 603 supplies the current to the driving motor 604, based on the PWM setting value (i.e., D (n) % illustrated in FIG. 8). Further, the CPU 601 sets the count value to 0 upon outputting the start signal at the time t0.

After the motor driving circuit 603 has started rotationally driving the driving motor 604, the rotational speed of the driving motor 604 starts to rise. At this time, the sensor output detection circuit 607 is outputting the high-level signal. That is, the pump unit 210 of the toner bottle T is not contracting.

Then, the signal output from the sensor output detection circuit 607 changes from the high-level signal to the low-level signal at a time t1. The CPU 601 outputs the count start signal in response to the signal output from the sensor output detection circuit 607 changing from the high-level signal to the low-level signal. As a result, the count value Tn starts to increase. At this time, as the sensor output detection circuit 607 is outputting the low-level signal, the pump unit 210 is starting to contract.

Next, the signal output from the sensor output detection circuit 607 changes from the low-level signal to the high-level signal at a time t2. The CPU 601 outputs the stop signal in response to the signal output from the sensor output detection circuit 607 changing from the low-level signal to the high-level signal. As a result, the count value Tn stops increasing, and the motor driving circuit 603 stops rotationally driving the driving motor 604. At this time, it is indicated that the pump unit 210 of the toner bottle T has fully contracted. The CPU 601 causes the motor driving circuit 603 to stop rotationally driving the driving motor 604, so that the rotational driving of the toner bottle T is stopped before the pump unit 210 expands.

According to the above-described exemplary embodiment, the pump unit 210 is configured to fully contract at the timing when the signal output from the sensor output detection circuit 607 changes from low-level to high-level. The rotational driving of the toner bottle T is stopped at the timing when the output signal changes from low-level to high-level, so that the toner bottle T can perform an intake operation when the toner bottle T subsequently starts to rotate. As a result, the toner accumulated on the discharge port 211 of the toner bottle T can be loosened, and the toner can be discharged from the discharge port 211 of the toner bottle T.

Further, according to the present exemplary embodiment, the toner bottle T is configured so that two projection portions 220 are disposed over the circumference of the drive transmission unit 206, and the toner supplying operation is performed twice while the toner bottle T rotates once. However, the toner bottle T may be configured so that the toner supplying operation is performed only once while the toner bottle T rotates once. In such a case, it is sufficient that the toner bottle T has a configuration including only one projection portion 220 disposed on the drive transmission unit 206. The toner supplying operation is performed so that the toner bottle T supplies toner to the developing unit 100 while the sensor output detection circuit 607 outputs the low-level signal in response to the rotation detection sensor 203 detecting the projection portion 220.

Further, the toner bottle T may be configured so that the toner supplying operation is performed three or more times while the toner bottle T rotates once. In such a case, the toner bottle T includes three or more projection portions 220 disposed on the drive transmission unit 206. The toner supplying operation is performed so that the toner bottle T supplies toner to the developing unit 100 while the sensor output detection circuit 607 outputs the low-level signal in response to the rotation detection sensor 203 detecting the projection portion 220.

Furthermore, according to the present exemplary embodiment, the image forming apparatus is configured so that the signal output from the sensor output detection circuit 607 changes from high-level to low-level at the timing when the toner bottle T starts to contract. However, the configuration is not limited thereto. More specifically, the image forming apparatus may be configured so that the signal output from the sensor output detection circuit 607 changes from high-level to low-level after a predetermined time from when the toner bottle T starts to contract. Similarly, according to the present exemplary embodiment, the image forming apparatus is configured so that the signal output from the sensor output detection circuit 607 changes from low-level to high-level after the toner bottle T has fully contracted. However, the configuration is not limited thereto. More specifically, the image forming apparatus may be configured so that the signal output from the sensor output detection circuit 607 changes from low-level to high-level before the toner bottle T has fully contracted.

Moreover, according to the present exemplary embodiment, the sensor output detection circuit 607 is configured to output the low-level signal while the toner bottle T is performing the toner supplying operation, and output the high-level signal while the toner bottle T is not performing the toner supplying operation. However, the output signals of the sensor output detection circuit 607 may have an inverse relation. More specifically, the sensor output detection circuit 607 may be configured to output the high-level signal while the toner bottle T is performing the toner supplying operation, and output the low-level signal while the toner bottle T is not performing the toner supplying operation.

Further, according to the present exemplary embodiment, the image forming apparatus is configured so that the low-level signal is continuously output while the toner bottle T is performing the toner supplying operation. However, the image forming apparatus may be configured so that a signal (a first signal) by which it is identifiable that the pump unit 210 has started contracting and a signal (a second signal) by which it is identifiable that the pump unit 210 has fully contracted are output. In such a case, it is sufficient that the CPU 601 is configured to correct the PWM setting value for rotationally driving the toner bottle T based on the time from when the sensor output detection circuit 607 outputs the first signal to when it outputs the second signal.

Furthermore, according to the present exemplary embodiment, the image forming apparatus is configured so that the toner supplying operation is performed in a case where the amount of toner in the developing unit 100 has become less than a predetermined amount. However, the image forming apparatus may be configured so that the toner supplying operation is performed in a case where the percentage of toner in the developing unit 100 has become less than a predetermined percentage. For example, if the developing unit 100 is configured to develop an electrostatic latent image using a two-component developer including toner and a carrier, it is sufficient that the CPU 601 compares the percentage of the amount of the toner to the amount of the developer with the predetermined percentage.

According to an embodiment of the present invention, the amount of toner discharged from the container can be controlled with high precision.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-159297 filed Jul. 31, 2013, which is hereby incorporated by reference herein in its entirety.

What is claimed is:

1. An image forming apparatus comprising:

a photosensitive member;

an exposure unit configured to expose the photosensitive member to form an electrostatic latent image on the photosensitive member;

a developing unit configured to develop using toner the electrostatic latent image formed on the photosensitive member by the exposure unit;

a container including a containing unit configured to contain toner and a pump unit configured to change internal pressure of the containing unit, wherein, the pump unit in the container expands and contracts according to rotation of the container, and the container supplies toner from the containing unit to the developing unit, a driving unit configured to rotate the container;

a detection unit configured to detect a predetermined portion of the rotating container; and a controller configured to control the driving unit so that a rotational speed of the container becomes a predetermined speed, based on a detection result of the detection unit, wherein, in a case where toner is to be supplied from the container to the developing unit, the container changes from a first state in which the pump unit has contracted to a second state in which the pump unit has expanded, and changes from the second state to the first state, and wherein, the controller stops the driving unit in response to the detection unit detecting a trailing edge area included in the predetermined portion.

2. The image forming apparatus according to claim 1, wherein the controller is further configured to stop the driving unit in a state where the pump unit has contracted.

3. The image forming apparatus according to claim 1, wherein the predetermined portion includes a leading edge area and a trailing edge area in a direction in which the container rotates, wherein a period for which the predetermined portion of the rotating container is detected by the detection unit includes a period for which the pump unit is maintained in a contracted state, and wherein the controller corrects, based on a time from a first point of time at which the detection unit has detected the leading edge area to a second point of time at which the detection unit has detected the trailing edge area, a control value for controlling the driving unit.

4. The image forming apparatus according to claim 3, wherein, in a case where a operation for supplying toner from the container to the developing unit has not started from a state where the pump unit has contracted, the controller does not perform correction of the control value.

5. The image forming apparatus according to claim 3, wherein the driving unit is a DC motor, and wherein the control value is a value for controlling a current to be supplied to the driving unit.

6. The image forming apparatus according to claim 1, wherein the container includes a groove which rotates according to rotation of the container and an engaging member engaged with the groove and connected to the pump unit, and wherein the pump unit expands and contracts along the groove.

7. The image forming apparatus according to claim 1, wherein the container supplies the toner to the developing unit a plurality of times while the container rotates once.

8. The image forming apparatus according to claim 1, further comprising a mounting unit, wherein the container is mounted to the mounting unit.

9. The image forming apparatus according to claim 1, wherein the detection unit detects the predetermined portion of the rotating container in a period for which the rotational speed of the container is stabilized.

10. An image forming apparatus comprising:

a photosensitive member;

an exposure unit configured to expose the photosensitive member to form an electrostatic latent image on the photosensitive member;

a developing unit configured to develop the electrostatic latent image formed on the photosensitive member, using a toner;

a mounting unit to which a container is mounted, wherein the container comprises:

a containing unit configured to contain a toner; and a pump unit that expands and contracts to change an internal pressure of the containing unit, thereby supply the toner from the containing unit to the developing unit;

a driving unit configured to rotate the container mounted to the mounting unit and cause the pump unit to expand and contract in conjunction with a motion for rotating the container;

a detection unit configured to detect a predetermined portion of the rotating container to obtain information related to a rotational speed of the container, and a controller configured to perform a feedback control based on the information obtained by the detection unit to control the driving unit such that a rotational speed of the container becomes a predetermined speed, wherein after executing a replenishing operation for replenishing the toner from the containing unit to developing unit, the controller stops a rotation of the container based on a detection result of the detection unit, wherein an amount of the toner that is supplied from the containing unit to the developing unit varies based on the rotational speed of the container which is rotated by the driving unit.

11. The image forming apparatus according to claim 10, wherein the controller stops a rotation of the container after the pump unit contracts and before the pump unit expands.

12. The image forming apparatus according to claim 10, wherein the predetermined portion includes a first portion and a second portion in a direction in which the container rotates, and wherein the controller performs the feedback control based on a time from a first point of time at which the detection unit had detected the first portion to a second point of time at which the detection unit has detected the second portion.

13. The image forming apparatus according to claim 10, wherein in a case where the replenishing operation is executed from a state where the detection unit is detecting the predetermined portion, the controller does not perform the feedback control.

14. The image forming apparatus according to claim 10, wherein the driving unit is a DC motor, and wherein the controller controls a current to be supplied to the driving unit.

15. The image forming apparatus according to claim 10, wherein the container includes a groove which rotates according to rotation of the container and an engaging member engaged with the groove and connected to the pump unit, and wherein the pump unit expands and contracts along the groove.

16. The image forming apparatus according to claim 10, wherein the detection unit detects the predetermined portion of the rotating container in a period for which the rotational speed of the container is stabilized.

17. The image forming apparatus according to claim 10, wherein the controller controls a rotational speed of the container based on a control value, and wherein every time that the pump unit completes a contraction once, the controller updates the control value based on the information obtained by the detection unit.

* * * * *